US008511382B2

(12) United States Patent
Nukhaev et al.

(10) Patent No.: US 8,511,382 B2
(45) Date of Patent: Aug. 20, 2013

(54) METHOD FOR DETERMINING FILTRATION PROPERTIES OF ROCKS

(75) Inventors: Marat Tokhtarovich Nukhaev, Moscow Region (RU); Vladimir Vasilievich Tertychnyi, Moscow (RU); Alexandr Nikolaevich Shandrygin, Moscow (RU); Yan Kuhn De Chizelle, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 468 days.

(21) Appl. No.: 12/279,925

(22) PCT Filed: Feb. 6, 2007

(86) PCT No.: PCT/RU2007/000056
§ 371 (c)(1),
(2), (4) Date: Jul. 29, 2010

(87) PCT Pub. No.: WO2007/094705
PCT Pub. Date: Aug. 23, 2007

(65) Prior Publication Data

US 2010/0288490 A1 Nov. 18, 2010

(30) Foreign Application Priority Data

Feb. 17, 2006 (RU) ..... 2006104892

(51) Int. Cl.
*E21B 47/06* (2012.01)
*E21B 43/24* (2006.01)
*G01N 15/08* (2006.01)

(52) U.S. Cl.
USPC ..... 166/302; 166/250.02; 166/272.3; 166/303; 702/12; 703/10

(58) Field of Classification Search
USPC ..... 166/302, 303, 272.1, 272.3, 272.6, 166/272.7; 702/12; 703/10
See application file for complete search history.

(56) References Cited

U.S. PATENT DOCUMENTS 2,739,475 A 3/1956 Nowak
3,864,969 A 2/1975 Smith, Jr.

(Continued)

FOREIGN PATENT DOCUMENTS

GB 2397648 A 7/2004
RU 1819323 A3 5/1993

(Continued)

OTHER PUBLICATIONS

Yamschikov, "Mining Process Control," Nedra, Moscow, 1989: pp. 66-69.

(Continued)

*Primary Examiner* — Giovanna Wright

(57) ABSTRACT

A method of determining a permeability profile of a heavy-oil bearing formation includes pre-heating of the formation by circulation of steam in a well, creating an excessive pressure inside the well during the pre-heating stage, stopping circulation of steam in the well, measuring temperature along a well bore of the well using distributed temperature sensors, wherein the measuring is performed from a moment at which steam circulation stops until a thermally stable condition is achieved, creating a conductive heat exchange model relating a quantity of steam penetrated into the formation to a local permeability of the formation, the model being created using the temperature measurement results of the pre-heating stage for solving an inverse problem, and determining the formation permeability profile from the created model.

1 Claim, 4 Drawing Sheets

(56) References Cited

U.S. PATENT DOCUMENTS

| | | | | |
|---|---|---|---|---|
| 4,120,355 | A * | 10/1978 | Knepper et al. | 166/259 |
| 6,618,677 | B1 | 9/2003 | Brown | |
| 2007/0068672 | A1 * | 3/2007 | Jalali et al. | 166/250.01 |

FOREIGN PATENT DOCUMENTS

| | | | |
|---|---|---|---|
| RU | 2045082 | C1 | 9/1995 |
| RU | 2139417 | C1 | 10/1999 |
| RU | 2151866 | C1 | 6/2000 |
| RU | 2194160 | C2 | 12/2002 |
| SU | 665082 | | 5/1979 |
| SU | 1395819 | A1 | 5/1988 |
| WO | 2005035944 | A1 | 4/2005 |

OTHER PUBLICATIONS

Examination Report of Canadian Patent Application No. 2,642,589 dated Mar. 9, 2010: pp. 1-3.

Office Action of Chinese Patent Application Serial No. 200780009498.6 dated May 16, 2012: pp. 1-4.

International Search Report of PCT Application No. PCT/RU2007/000056 dated Jun. 28, 2007: pp. 1-2.

Butler, "Chapter 11: Thermal Recovery Using Horizontal Wells," Horizontal Wells for the Recovery of Oil, Gas and Bitumen, Calgary: Petroleum Society of the Canadian Institute of Mining, Metallurgy and Petroleum, 1994: pp. 171-194.

* cited by examiner

METHOD FOR DETERMINING FILTRATION PROPERTIES OF ROCKS

FIELD OF THE DISCLOSURE

This invention relates to the oil and gas industry, more specifically, to the development of heavy oil and natural bitumen fields.

BACKGROUND OF THE DISCLOSURE

The growth of hydrocarbon prices and the inevitable depletion of light oil resources have recently caused increasing attention to development of heavy oil and asphaltic bitumen deposits. Among the existing methods of developing high viscosity hydrocarbon deposits (e.g., mining, solvent injection etc.), thermal methods (hot water injection, thermal-steam well treatment, thermal-steam formation treatment etc.) are known for their high oil recovery and withdrawal rate.

A thermal-steam gravity treatment method (SAGD) is known which is currently one of the most efficient heavy oil and asphaltic bitumen deposit development methods (Butler R., "Horizontal Wells for the Recovery of Oil, Gas and Bitumen," Calgary: Petroleum Society of Canadian Institute of Mining, Metallurgy and Petroleum, 1994: pp. 171-194.). This method creates a high-temperature 'steam chamber' in the formation by injecting steam into the top horizontal well and recovering oil from the bottom well. In spite of its worldwide use, this deposit development method requires further improvement, i.e., by increasing the oil-to-steam ratio and providing steam chamber development control.

One way to increase the efficiency of SAGD is process control and adjustment based on permanent temperature monitoring. This is achieved by installing distributed temperature measurement systems in the wells. One of the main problems related to thermal development methods (e.g., steam assisted gravity drainage) is steam (hot water, steam/gas mixture) breakthrough towards the production well via highly permeable interlayers. This greatly reduces the heat carrier usage efficiency and causes possible loss of downhole equipment. Steam breakthrough response requires repair-and-renewal operations that in turn cause loss of time and possible halting of the project. This problem is especially important for the steam assisted gravity development method due to the small distances (5-10 m) between the production and the injection wells.

A method of active temperature measurements of running wells is known (RU 2194160). The known invention relates to the geophysical study of running wells and can be used for the determination of annulus fluid flow intervals. The technical result of the known invention is increasing the authenticity and uniqueness of well and annulus fluid flow determination. This is achieved by performing temperature vs. time measurements and comparing the resultant temperature vs. time profiles during well operation. The temperature vs. time profiles are recorded before and after short-term local heating of the casing string within the presumed fluid flow interval. Fluid flow parameters are determined from temperature growth rate.

A method of determining the permeability profile of geological areas is known (RU 2045082). The method comprises creating a pressure pulse in the injection well and performing differential acoustic logging and temperature measurements in several measurement wells. Temperature is measured with centered and non-centered gages. The resultant functions are used to make a judgment on the permeability inhomogeneity of the string/cement sheath/formation/well system, and thermometer readings are used to determine the permeability vector direction. Disadvantages of this method are as follows:

- only generalized integral assessment of geological area permeability is possible;
- additional multiple measurements (acoustic logging) in several wells are necessary;
- the method is not suitable for the characterization of high viscosity oil and bitumen saturated rocks.

SUMMARY OF THE DISCLOSURE

The object of the method described herein is to broaden its application area and provide the possibility of quantifying a permeability profile of a heavy-oil bearing formation along a well bore, thereby increasing efficiency of a heat carrier usage and reducing equipment losses during reservoir development.

This object is achieved by using a new sequence of measurements and steps, and applying an adequate mathematical model of a process.

Advantages of the method described herein are the possibility of characterizing high viscosity oil and bitumen saturated rocks and using standard measurement tools. Moreover, the sequence of steps described herein does not interrupt the process of thermal development works.

The method for determining a permeability profile of a heavy-oil bearing formation comprises pre-heating of the formation by circulation of steam in a well, creating an excessive pressure inside the well during the pre-heating stage, stopping circulation of steam in the well, measuring temperature along a well bore of the well using distributed temperature sensors, wherein the measuring is performed from a moment at which steam circulation stops until a thermally stable condition is achieved, creating a conductive heat exchange model relating a quantity of steam penetrated into the formation to a local permeability of the formation, the model being created using the temperature measurement results of the pre-heating stage for solving an inverse problem, and determining the formation permeability profile from the created model.

BRIEF DESCRIPTION OF THE FIGURES

The invention will be exemplified below with drawings where.

DETAILED DESCRIPTION

Figure 1:
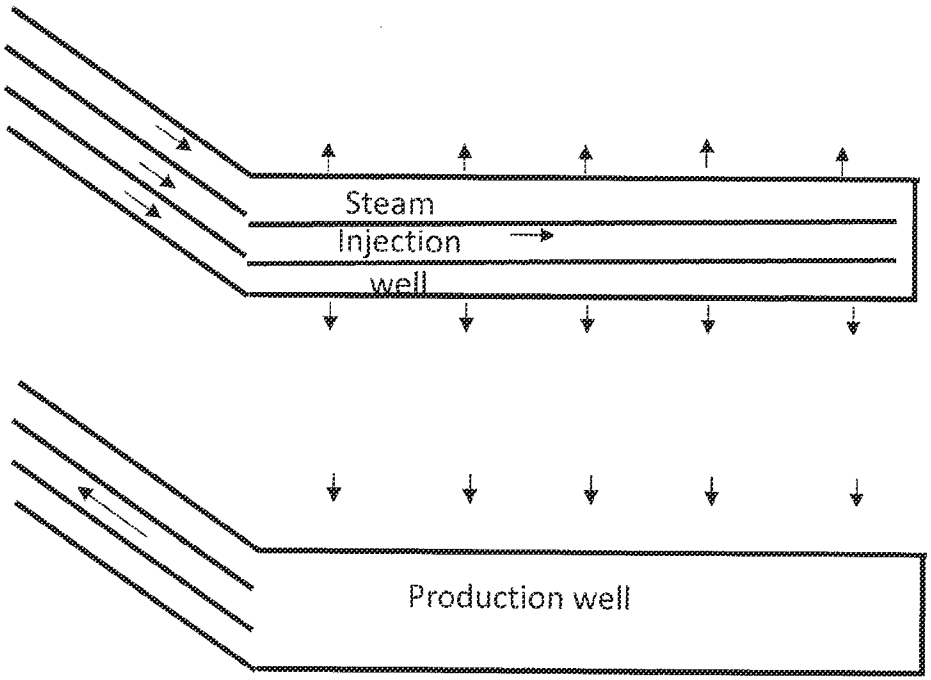
FIG. 1 shows a preheating stage.
Figure 2:
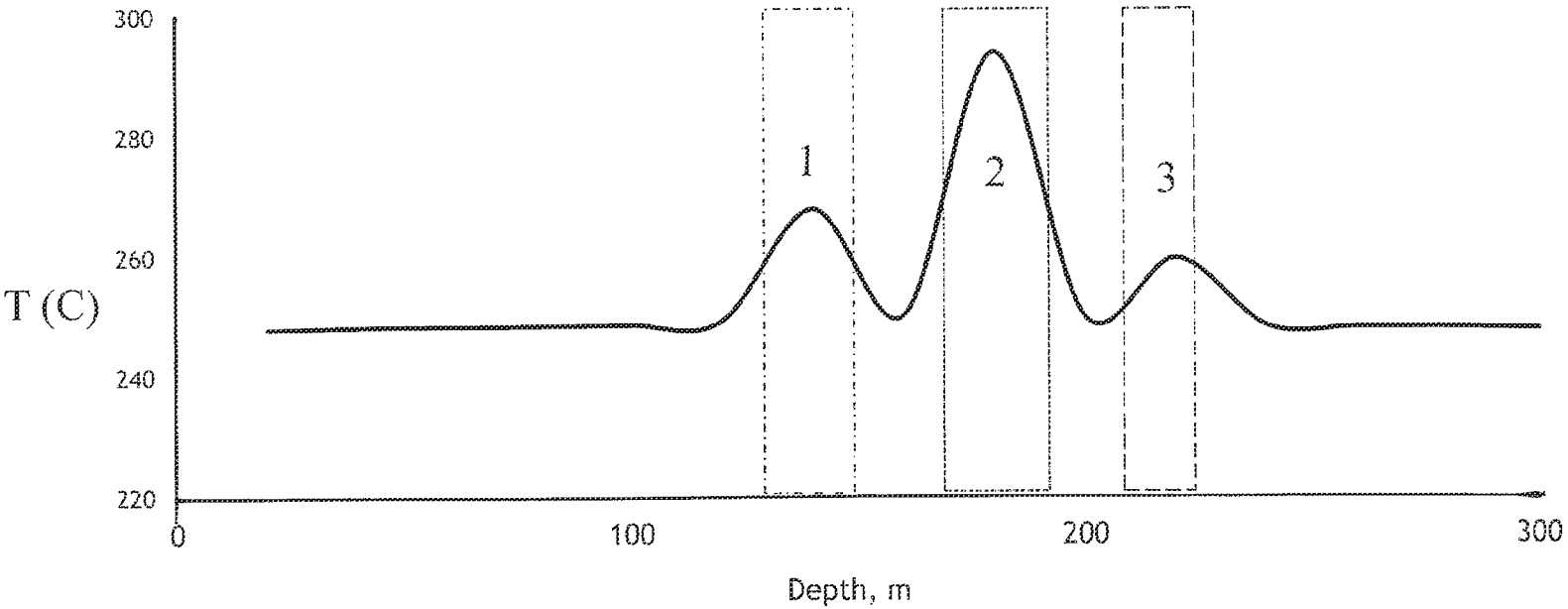
FIG. 2 shows temperature distribution along a well bore after the preheating.

The method described herein requires distributed temperature measurements over the whole length of the portion of interest at a preheating stage. At that stage (FIG. 1), a hydrodynamic connection is established between wells by heating a cross borehole space. In a standard steam-assisted gravity development technology, this is achieved by heating of a formation by steam circulation in both horizontal wells. The method of determining a permeability profile of a heavy-oil bearing formation described herein requires additional works, i.e., partially closing an annulus of a well at the preheating stage to create an excessive pressure inside a well-bore. This pressure will force the steam to penetrate into the formation. An amount of steam penetrated into oil-saturated beds (and hence an amount of heat) will depend on a local permeability of the formation (FIG. 2). FIG. 2 shows zones of the formation having different permeabilities: zone (1) K=3 $\mu m^2$, zone (2) K=5 $\mu m^2$, zone (3) K=2 $\mu m^2$, while other zones K=0.5 $\mu m^2$. As can be seen from FIG. 2, a temperature signal received after stopping steam circulation will be provided by highly permeable formation zones. Moreover, a temperature restoration rate will depend on the permeabilities of local zones. Thus, the temperature measurement results (provided by the distributed measurement system) after stopping the circulation of steam can be used for estimating the permeability profile along the well bore.

Figure 3:
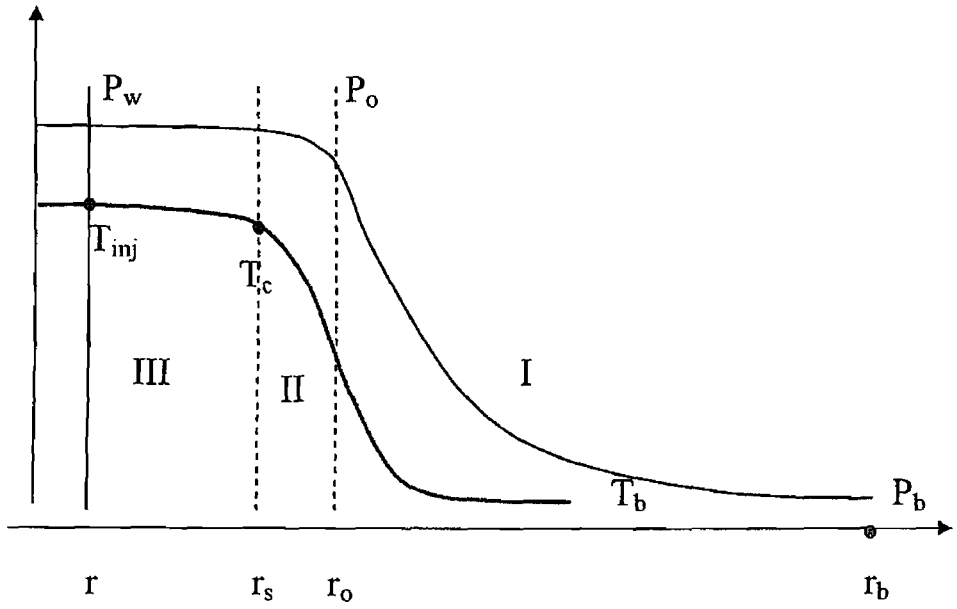
FIG. 3 shows pressure and temperature profiles during steam injection and FIG. 4 shows results of temperature inversion procedure for determination of permeability profile based on an analytical model.

To solve an inverse problem, this method provides an analytical model satisfying the following properties and having the following boundary conditions:

- a one-dimensional frontal cylindrical symmetrical model;
- in an initial condition, a pore space is fully saturated with oil/bitumen;
- the following zones are formed during an injection of steam into the formation (FIG. 3): steam (III), hot water and hot oil (II) and cold oil (I);
- a boundary of an oil/water front is determined as a boundary between the zones filled with fluids having a significant difference in viscosity (a cold highly viscous oil having viscosity $\mu_0$ and steam, water and a hot formation fluid having average viscosity $\mu_1$).

The boundary of the oil/water front can be determined using the following equation:

$$r_o = \sqrt{r_w^2 + \frac{q^* \cdot t_c}{\pi \cdot \phi}}$$

where $$q^* = c_q \cdot \frac{k \cdot \Delta P}{\mu_0}.$$

The value of the parameter $c_q \approx 0.5 \div 1.5$ can be estimated from a numeric simulation/field experiments to consider the following specific features that can hardly be incorporated into a purely analytical model:

- the temperature and viscosity of oil near the oil/water front differs from those in the formation;
- actually, there is no clear boundary of the oil/water front (there is a transition oil/water mixture zone).

Thus, a radius of the oil/water front is determined by the following parameters:

- a permeability (k) of the formation;
- a repression upon the formation ($\Delta P$);
- a viscosity of oil in the formation ($\mu_0$).

The steam/water front boundary position is determined by energy and weight balance equations and can be found as follows:

$$\frac{dr_s}{dt} = \begin{cases} 0 & g_w > g_{wm} \\ \dfrac{g_{wm} - g_w}{2\pi \cdot \phi \cdot \rho_w \cdot r_s} & g_w \le g_{wm} \end{cases}$$

-continued $$r_s(t = 0) = r_w.$$

Where $$g_w \approx \frac{2\pi \cdot \lambda_{fw}}{c_w} \cdot \frac{\ln\left(1 + \dfrac{c_w \cdot \Delta T}{L + (c_s - c_w) \cdot T_c}\right)}{\ln\left(\dfrac{r_w + c_T \cdot \sqrt{a \cdot t_c}}{r_s(t)}\right)}$$

is a mass rate of steam condensation, $$g_{wm} = \rho_w \cdot q^* = \rho_w \cdot c_q \cdot \frac{\Delta P \cdot k}{\mu}$$

is a maximum rate of condensation, $\rho_w$ is a density of water, $\phi$ is a porosity of the formation, $\lambda_{fw}$ is a thermal conductivity of a water-saturated reservoir, $c_w$ is a heat capacity of water, $C_s$ is a heat capacity of steam, a is a thermal diffusivity of the formation, L is a heat of evaporation, $t_c$ is a duration of injection and $T_c$ is a temperature of steam condensation.

A temperature profile at the steam injection phase is as follows:

$$T(r) = \begin{cases} T_c & r \le r_s \\ T_0 + (T_c - T_0) \cdot \dfrac{1 - \left(\dfrac{r}{r_T}\right)^v}{1 - \left(\dfrac{r_s}{r_T}\right)^v} & r_s < r \le r_T,\ v = \dfrac{g_w \cdot c_w}{2\pi \cdot \lambda_{fw}} \\ T_0 & r_T < r \end{cases}$$

Temperature restoration after stopping steam circulation can be described with a simple conductive heat exchange model that does not consider phase transitions.

Figure 4:
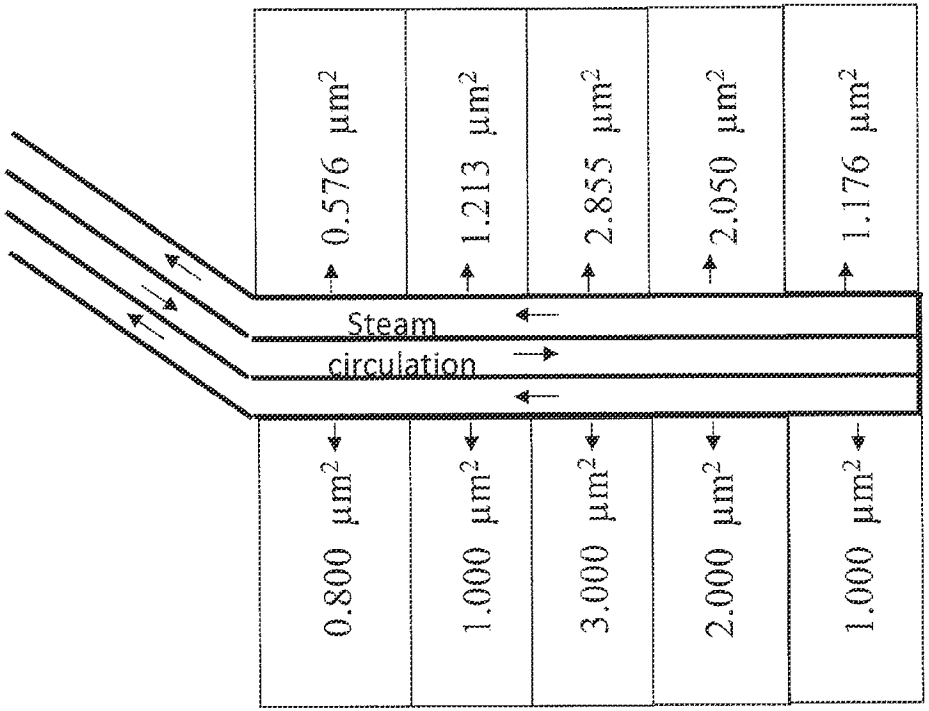

Example of permeability K distribution estimation based on temperature restoration rate measurements is shown in FIG. 4, an upper part showing results of the estimation and a lower part showing the simulated values.

Thus, the method of determining the formation permeability profile suggested herein allows quantification of the permeability profile along the well bore at an early stage of steam-assisted gravity drainage or another heat-assisted well development method. The resultant permeability profile can be used for the preventive isolation of highly permeable formations before the initiation of the main development stage and allows avoiding steam breakthrough towards the production well. The permeability profile along the whole well bore length is determined by measuring the non-steady-state thermal field with a distributed temperature measurement system.

The invention claimed is:

1. A method for determining-a permeability profile of a heavy-oil bearing formation, the method comprising:

pre-heating the formation by circulation of steam in a well, creating an excessive pressure inside the well during the pre-heating stage, stopping circulation of steam in the well, measuring temperature along a well bore of the well using distributed temperature sensors, wherein the measuring is performed from a moment at which steam circulation stops until a thermally stable condition is achieved;

creating a conductive heat exchange model relating a quantity of steam penetrated into the formation to a local permeability of the formation, the model being created using the temperature measurement results of the preheating stage for solving an inverse problem, and determining the formation permeability profile from the created conductive heat exchange model.

* * * * *